United States Patent [19]

Dadswell

[11] Patent Number: 4,894,628

[45] Date of Patent: Jan. 16, 1990

[54] TRANSMISSION DELAY LINE AND METHOD OF MANUFACTURE

[75] Inventor: Peter J. Dadswell, Gawler, Australia

[73] Assignee: The Commonwealth of Australia, Canberra, Australia

[21] Appl. No.: 163,966

[22] PCT Filed: Apr. 2, 1987

[86] PCT No.: PCT/AU87/00104

§ 371 Date: Dec. 2, 1987

§ 102(e) Date: Dec. 2, 1987

[87] PCT Pub. No.: WO87/06065

PCT Pub. Date: Oct. 8, 1987

[30] Foreign Application Priority Data

Apr. 2, 1986 [AU] Australia ..... PH5293

[51] Int. Cl.[4] ..... H01P 9/00; H01P 9/02; H01P 11/00

[52] U.S. Cl. ..... 333/160; 333/23; 333/162; 333/163; 29/600

[58] Field of Search ..... 333/23, 160, 162, 156, 333/243, 163, 244, 236, 245, 219, 222; 328/66, 67; 29/600

[56] References Cited

U.S. PATENT DOCUMENTS 3,199,054 8/1965 Holland et al. ..... 333/162 X

OTHER PUBLICATIONS

WO,A, 86/01039 (The Commonwealth of Australia) Feb. 13, 1986.

*Primary Examiner*—Marvin L. Nussbaum

*Attorney, Agent, or Firm*—Cushman, Darby & Cushman

[57] ABSTRACT

A transmission delay line including a helical channel (2) formed in the surface of a cylinder (1), with a conductive sleeve (7) fitted to the cylinder to close the channel. A helical conductive member (4) is positioned within the channel (2) and spaced from the walls thereof by a dielectric material (5, 9).

15 Claims, 2 Drawing Sheets

TRANSMISSION DELAY LINE AND METHOD OF MANUFACTURE

BACKGROUND OF THE INVENTION

This invention relates to an improved transmission lilne device for delaying electromagnetic energy and a method of manufacturing such a device.

Hollow metallic tubes (waveguides) of various transverse cross-sectional shapes exhibit well-known properties which fit them for use as a delay mechanism for electromagnetic waves. Such tubes, which propagate TE waves, are characterised by a wide bandwidth capability and a low insertion loss which is essentially constant over the operating range.

The family of transmission lines which include suspended stiplines, image line, coaxial line, and so on, propagate TEM or quasi-TEM waves and are also suitable for use as delay lines, but such devices, in general, exhibit a higher insertion loss due, in part, to energy losses in the dielectric component.

The cost of amplification at microwave frequencies is high. Consequently insertion loss will be an important consideration where a design calls for a substantial delay. The use of a waveguide may be indicated by virtue of its characteristic low insertion loss, but where the design is also sensitive to cost, weight and volumetric efficiency, the deployment of many metres of commercial waveguide section is likely to pose a problem.

According to our earlier invention, as published under PCT No. AU85/00171, an improved waveguide delay line is disclosed comprising a helical conducting channel formed in a cylinder, such as by machining, such channel being closed by a tightly-fitting conducting sleeve.

The method there disclosed, of fabricating a waveguide delay line for use at microwave frequencies, teaches a way of retaining the low insertion loss characteristic of a waveguide, whilst affording improved volumetric efficiency, low weight and low cost of manufacture. In addition, a delay line so constructed can be integrated into a parent structure as a load-bearing member.

It will be appreciated that in many weight-sensitive applications this duality of electronic function and mechanical load-bearing capability enhances the cost-effectiveness of the method of fabrication disclosed.

In summary, a waveguide delay line as described in the earlier Patent specification confers certain advantages:

(a) a structure that can be integrated into a system as a load-bearing member occupying minimum volume;
(b) extremely low weight per unit delay;
(c) low cost of manufacture;
(d) low cost penalty for varying design parameters;
(e) the low insertion loss characteristic of a normal commercial waveguide.

SUMMARY OF THE INVENTION

The object of the present invention is to provide an improved transmission line device for use as a delay mechanism by using the general method of construction of the invention referred to earlier herein, but with the addition of a conducting member supported within the said helical channel.

With such an addition well-known forms of transmission, line suitable for use as a delay line can be fabricated such as, for example, suspended strip line and co-axial line, but which now, by virtue of the present invention, shows an improved electrical performance, whilst also possessing the advantages indicated in (a), (b), (c) and (d) above.

Accordingly, the present invention comprises a transmission delay line characterised by a helical channel formed in the wall of a cylinder to give an elongated helical path for a travelling wave. A conductive sleeve fitting over the said cylinder closes the channel, the said channel being characterised by a helical conducting member in the channel separated from the walls of the channel by a dielectric material, which may be in the form of a continuous bed or discrete spacers.

DESCRIPTION OF THE DRAWINGS

To enable the invention to be fully appreciated, embodiments thereof will now be described with reference to the accompanying drawings, but the invention need not necessarily be limited to the form shown.

In the drawings.

DESCRIPTION OF THE PREFERRED EMBODIMENTS

Figure 1:
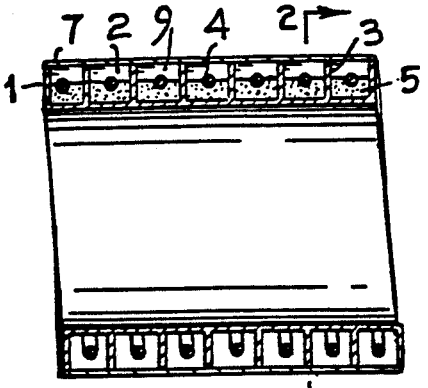
FIG. 1 and 2 are a longitudinal sectional view and a transverse sectional view on line 2—2 of FIG. 1 respectively, of a preferred form, of the transmission delay line of the present invention
Figure 2:
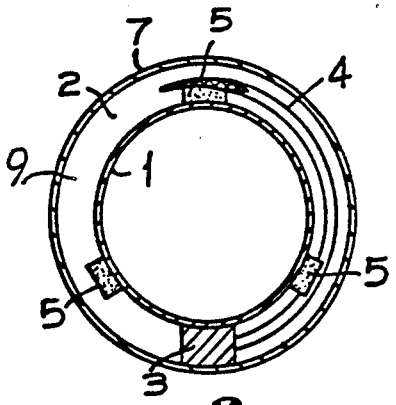
Figure 3:
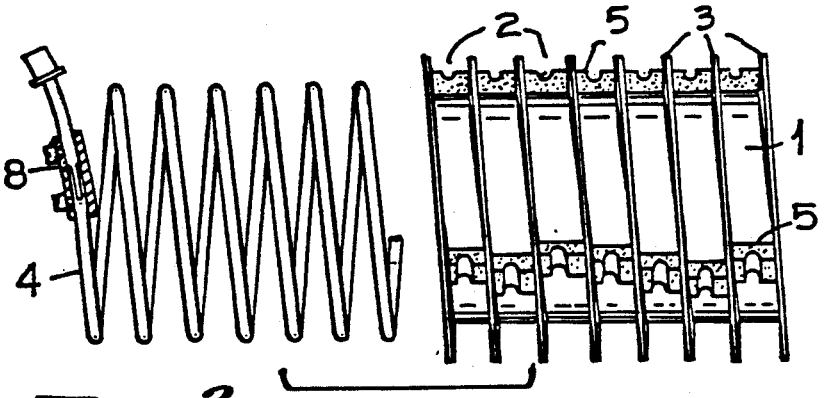
FIG. 3 shows the components of the line of FIGS. 1 and 2, before assembly.

Referring to FIGS. 1 to 5C, the cylinder 1 has in it a helical channel 2 formed between peripheral walls 3, the channel having positioned in it the helical conducting member 4, supported by spaced dielectric spacers 5.

Figure 4:
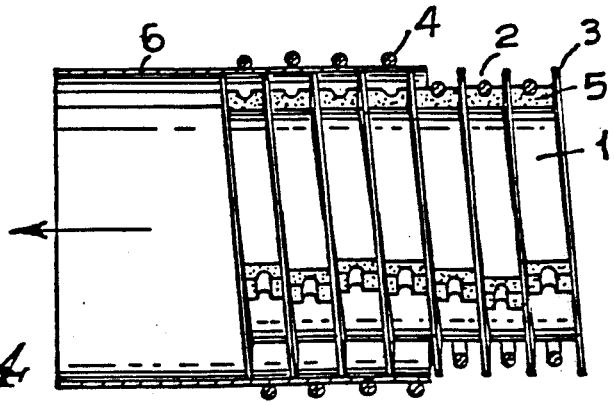
FIG. 4 shows a method of assembly, of the line of FIGS. 1–3

The helical conducting member 4 may be pre-formed as a spring and, during assembly may be counter-wound as shown in FIG. 4 onto a tubular support 6 which is placed over the cylinder 1 in which the helical channel 2 is formed, and, when the tubular support 6 is axially withdrawn, the convolutions of the helical conductor 4 contract into position in the helical channel 2.

After the helical conductor 4 is positioned in the channel, the helical conductor can have its ends coupled to the centre conductor of short lengths of semi-rigid cable mounted in segmental blocks 8 engaged in and secured to the helical channel 2.

The structure is completed by the sleeve 7 which is assembled over the cylinder 1 to close the helical channel.

Thus the helical conducting member 4 is separated from the walls of the channel 2, the dielectric spacers 5 being such that air is the predominant dielectric material.

Figure 5A:
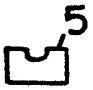
FIG. 5A and 5B show examples of dielectric support geometry suitable for circular section conductors and FIG. 5C shows a support geometry suitable for a strip conductor.
Figure 5B:
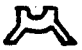
Figure 5C:
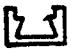

FIGS. 5A, 5B and 5C show three alternate forms of dielectric section, the embodiments shown in FIGS. 5A and 5B being suitable for a circular sectioned conductor, with the embodiment shown in FIG. 5A having a groove or recess in one surface of a block, while the embodiment shown in FIG. 5B has spaced legs to bear on the bottom of the channel. The embodiment shown in FIG. 5C C shows a further alternative suitable for a strip conductor, the spacer having a pair of notched arms into which the strip conductor may be fitted.

Figure 6:
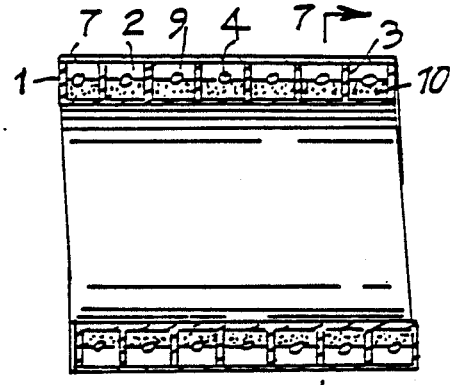
FIGS. 6 and 7 are a longitudinal sectional view and a transverse sectional view on line 7'7 of FIG. 6, respectively, of a second preferred form of the transmission delay line of the present invention.
Figure 7:
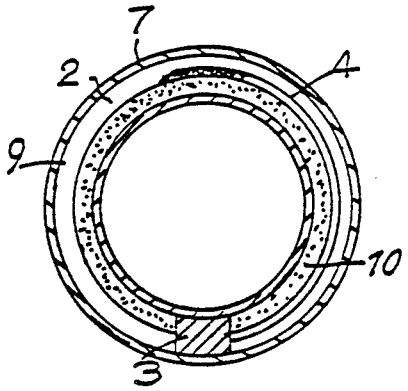

In a further preferred form of the invention as shown in FIGS. 6 and 7, the dielectric support is a dielectric bed 10 in the form of a continuous strip laid in the channel 2. This eliminates the need to assemble separate supports in a staggered pattern, and thus eliminates cyclic build up of losses which would occur with regular spacing. Preferably, the dielectric material is a low density foam material.

The improved electrical performance of the delay line here disclosed flows from the geometry which permits the line to be virtually air-cored, whilst retaining those mechanical properties appropriate to the maintenance of electrical performance, even when exposed to high 'g' forces. With air as the substantial dielectric, the surface area of the conducting elements can be increased for any given $Z_o$, with a subsequent reduction in $I^2_R$ losses, there being an optimum $Z_o$ at which such losses can be minimised, whilst retaining the same mode-free bandwidth. Further, the insertion loss due to a solid load-bearing dielectric, such as that normally associated with co-axial cable, for example, is virtually eliminated.

Dimensioned to be mode-free in the $K_u$ band, for example, an insertion loss of 15 dB/100 ft at 18 GHz is readily achieved by the co-axial form of the present invention, with a significant weight advantage per unit delay over typical low-loss co-axial cable. A further cost/weight advantages flows from the mechanical load-bearing capability of the line here disclosed.

In addition to low weight, high strength and low insertion loss, further advantages which stem from a virtually air-cored line constructed according to the present invention are:

(a) enhanced phase stability;

(b) relative freedom from phase change with tempeature;

(c) relative freedom from increases attenuation due to ageing or the permanent increase in attenuation often induced by exposure to high temperature.

The method of construction consists of machining or otherwise forming a conducting channel, preferably of square or rectangular transverse cross section, in the wall of a first member, preferably tubular, and asssembling a conductive element within the channel so formed, the location of the conductive element being determined by the geometry of the supporting dielectric placed in the channel.

The geometry of the delay line is such that the dielectric need occupy only half of the channel section to support the centre-conducting helix. Further, the dielectric is not required to resit the mechanical stresses normally associated with a flexible co-axial cable; the dielectric of the helical line need resist only the distributed 'g' forces generated by the light-weight centre helix under operational conditions.

Thus, the material chosen for the dielectric can have a dielectric constant approaching that of air, whilst still possessing sufficient mechanical strength to support the helix.

The outer conductive thin wall sleeve can be assembled over the first tubular member by a simple differential heat process to close the open helical channel.

In the co-axial form, with air as the substantial dielectric, the centre conductor, which may be made of aluminium alloy, will normally be of a diameter such that it can be pre-wound as a self-supporting helix on a mandrel, the mandrel being so dimensioned that, upon releases, the helix will spring to a greater diameter than the original winding, but still such as to exert a 'grip' upon the supporting dielectric support when assembled. The centre conductor can be silver plated and protected by a suitable conformal coating. Feed connections to the inner conductor can be made by standard commercial connectors.

I claim:

1. A coaxial transmission delay line, comprising:

a cylindrical tube of electrically-conductive material having a radially outwardly-extending helical wall cycling helically thereabout between axially opposite ends of said cylindrical tube on a radially outer peripheral surface of said cylindrical tube, said helical wall having a radially outer edge which is disposed a constant radial distance from said radially outer peripheral surface of said cylindrical tube, successive turns of said helical wall being axially spaced so as to define a helical slot of space;

a sleeve of electrically-conductive material radially surrounding said helical wall between said axially opposite ends of said cylindrical tube, said sleeve having a radially inner peripheral surface engaging said radially outer edge of said helical wall, thereby defining a radially outer limit to said helical slot of space so that said helical slot of space forms a helical channel having a given transverse cross-sectional shape, viewed on a longitudinal section of said coaxial transmission delay line;

support means made of low density dielectric material, said support means being received in said helical channel so as to be present at at least a plurality of sites per helical turn of said helical channel, said support means being supported from said radially outer peripheral surface of said cylindrical tube and having a thickness, extending radially outwardly of said radially outer peripheral surface of said cylindrical tube, which is less than said constant radial distance, whereby a helical gap remains between a radially outer surface of said support means and said radially inner peripheral surface of said sleeve;

means defining a radially outwardly-facing seat means on said support means, said seat means being located laterally intermediate respective adjacent turns of said helical wall, said seat means extending helically with said helical channel so as to be located generally centrally of said helical channel at said sites;

a single center conductor formed in a helix and extending helically of said cylindrical tube, generally between said opposite ends of said cylindrical tube, in said gap of said helical channel, supported in said seat means of said support means;

said single center conductor being so sized that a portion of said gap between said single center conductor and respective adjacent turns of said helical wall and between said single center conductor and said radially inner peripheral surface of said sleeve, remains unoccupied;

said unoccupied porton of said gap provides an unbroken and unimpeded helical passageway for an introduced gas between opposite ends of said coaxial transmission delay line.

2. The coaxial transmission delay line of claim 1, wherein:

said cylindrical tube and said sleeve are made of metal, and said sleeve compressively engages said radially outer edge of said helical wall, thereby providing a mechanical load-bearing structure.

3. The coaxial transmission delay line of claim 1, wherein:

said support means is discontinuous helically along said helical channel.

4. The coaxial transmission delay line of claim 1, wherein:

said support means has a relieved transverse cross-sectional shape so as to define with at least one of said single center conductor, said radially outer peripheral wall of said cylindrical tube, and respective adjacent turns of said helical wall, a further unoccupied space extending unbroken and unimpeded helically along said helical channel providing further passageway space for an introduced gas between opposite ends of said coaxial transmission delay line, said helical passageway and said further passageway space cumulatively being sufficient in transverse cross-sectional area that an introduced gas when provided therein may forma predominant proportion of dielectric material in said helical channel.

5. The coaxial transmission delay line of claim 1, wherein:

said single center conductor is in resilient compressive contact with said seat means.

6. The coaxial transmission delay line of claim 1, wherein:

said support means is of constant transverse cross-sectional shape and continuous helically along said helical channel.

7. The coaxial transmission delay line of claim 6, wherein:

said support means has a relieved transverse cross-sectional shape so as to define with at least one of said single center conductor, said radially outer peripheral wall of said cylindrical tube, and respective adjacent turns of said helical wall, a further unoccupied space extending unbroken and unimpeded helically along said helical channel providing further passageway space for an introduced gas between opposite ends of said coaxial transmission delay line, said helical passageway and said further passageway space cumulatively being sufficient in transverse crosssectional area that an introduced gas when provided therein may forma predominant proportion of dielectric material in said helical channel.

8. The coaxial transmission delay line of claim 1, further including:

a semi-rigid cable mounted in segmental blocks secured in said helical channel at opposite ends of said coaxial transmission delay line and connected at opposite ends of said coaxial transmission delay line to said single center conductor.

9. A method for manufacturing a coaxial transmission delay line, comprising:

providing a cylindrical tube of electrically-conductive material having a radially outwardly-extending helical wall cycling helically thereabout between axially opposite ends of said cylindrical tube on a radially outer peripheral surface of said cylindrical tube, said helical wall having a radially outer edge which is disposed a constant radial distance from said radially outer peripheral surface of said cylindrical tube, successive turns of said helical wall being axially spaced so as to define a helical slot of space;

providing support means made of low density dielectric material, said support means being received in said helical slot so as to be present at at least a plurality of sites per helical turn of said helical slot, said support means being supported from said radially outer peripheral surface of said cylindrical tube and having a thickness, extending radially outwardly of said radially outer peripheral surface of said cylindrical tube, which is less than said constant radial distance, whereby a helical gap remains between a radially outer surface of said support means and said radially outer edge of said helical wall, said support means having a radially outwardly-facing seat means provided thereon, said seat means being located laterally intermediate respective adjacent turns of said helical wall, said seat means extending helically with said helical slot so as to be located generally centrally of said helical slot at said sites;

providing a single center conductor as a spring-like member formed in a helix having a given internal diameter when in a radially unexpanded state;

providing a tubular support member having an end and having an outer peripheral surface which has a larger diameter than said given internal diameter, said tubular support having an inner peripheral surface which is at least as large as the radially outer diameter of said helical wall;

radially resiliently expanding said single center conductor into a radially resiliently expanded states and sleeving said single center conductor in said radially resiliently expanded state onto said outer peripheral surface of said tubular support member;

sleeving said tubular support member bearing said single center conductor in said radially resiliently expended state onto said cylindrical tube, radially outwardly of said helical wall;

while progressively axially de-sleeving said tubular support in relation to said cylindrical tube, progressively slipping said single center conductor off said end of said tubular support so that said single center conductor at least partially recovers towards said radially unexpanded state thereof and progressively becomes supported in said seat means of said support means;

providing a sleeve of electrically-conductive material having a radially inner peripheral surface; and sleeving said sleeve of electrically conductive material onto said cylindrical tube so that said sleeve of electrically-conductive material radially surrounds said helical wall between said axially opposite ends of said cylindrical tube and said radially inner peripheral surface engages said radially outer edge of said helical wall, thereby defining a radially outer limit to said helical slot of space so that said helical slot of space forms a helical channel having a given transverse cross-sectional shape, viewed on a longitudinal section of said coaxial transmission delay line.

10. The method of claim 9, wherein:

said single center conductor is so sized that a portion of said gap between said single center conductor and respective adjacent turns of said helical wall and between said single center conductor and said radially inner peripheral surface of said sleeve, remains unoccupied; and provides an unbroken and unimpeded helical passageway for an introduced gas between opposite ends of said coaxial transmission delay line.

11. The method of claim 9, further including:

radially shrinking said sleeve of electrically conductive material when in place on said cylindrical tube, so that said sleeve of electrically conductive material compressively engages said radially outer edge of said helical wall, thereby providing a mechanical load-bearing structure.

12. The method of claim 9, wherein:

said support means is provided so as to be discontinuous helically along said helical channel.

13. The method of claim 9, wherein:

said support means is provided so as to have a relieved transverse cross-sectional shape so as to define with at least one of said single center conductor, said radially outer peripheral wall of said cylindrical tube, and respective adjacent turns of said helical wall, a further unoccupied space extending unbroken and unimpeded helically along said helical channel providing further passageway space for an introduced gas between opposite ends of said coaxial transmission delay line, said helical passageway and said further passageway space cumulatively being sufficient in transverse cross-sectional area that an introduced gas when provided therein may form a predominant proportion of dielectric material in said helical channel.

14. The method of claim 9, wherein:

said single center conductor when slipped off of said tubular support and onto said support means only partially recovers to said radially unexpanded state, and thereby remains in resilient compressive contact with said seat means.

15. The method of claim 9, wherein:

said support means is provided so as to be of constant transverse cross-sectional shape and continuous helically along said helical channel.

* * * * *